United States Patent [19]

Dyck et al.

[11] Patent Number: 4,527,066

[45] Date of Patent: Jul. 2, 1985

[54] CONCRETE SHIELDING HOUSING FOR RECEIVING AND STORING A NUCLEAR FUEL ELEMENT CONTAINER

[75] Inventors: Hans-Peter Dyck, Burgdorf; Harry Spilker, Bad Muender; Heinz-Dieter Gregor, Hanover, all of Fed. Rep. of Germany

[73] Assignee: Deutsche Gesellschaft für Wiederaufarbeitung von Kernbrennstoffen mbH, Hanover, Fed. Rep. of Germany

[21] Appl. No.: 437,736

[22] Filed: Oct. 29, 1982

[30] Foreign Application Priority Data

Nov. 6, 1981 [DE] Fed. Rep. of Germany ..... 3144116

[51] Int. Cl.[3] ..... G21F 5/00

[52] U.S. Cl. ..... 250/507.1; 250/506.1; 252/633

[58] Field of Search ..... 250/506.1, 507.1; 252/626, 633

[56] References Cited

FOREIGN PATENT DOCUMENTS 2091477A 7/1982 United Kingdom ..... 252/633

OTHER PUBLICATIONS

Nelson et al., "Retrievable Surface Storage Facility . . . ", *Nuclear Technology,* vol. 24, Dec. 1974, pp. 391–397.

*Primary Examiner*—Alfred E. Smith
*Assistant Examiner*—Jack I. Berman
*Attorney, Agent, or Firm*—Walter Ottesen

[57] ABSTRACT

The invention is directed to a concrete shielding housing for receiving and storing a transportable fuel element container which is suitable for storage and filled with spent nuclear reactor fuel elements. The outer dimensions of the fuel element container are somewhat smaller than the clear interior dimensions of the concrete shielding housing. The concrete shielding housing includes a pallet-like base which can be moved about from one location to another with the aid of a suitable vehicle such as a fork-lift truck. The housing also includes the concrete shielding wall placeable upon the base, and a cover which can be placed atop the upper end of the concrete shielding wall. At least one air inlet opening is provided at the lower region of the concrete shielding housing and, at the upper region thereof, there is provided at least one air outlet opening. The plan profile of the base is smaller than the plan profile of the concrete shielding wall so that the surface water which accumulates on the concrete shielding housing from falling rain can run off to the ground without hindrance. In addition to the advantageous runoff of the surface water from the concrete shielding housing, this configuration permits the transport corridors in the container storage area to be made narrower.

4 Claims, 3 Drawing Figures

CONCRETE SHIELDING HOUSING FOR RECEIVING AND STORING A NUCLEAR FUEL ELEMENT CONTAINER

FIELD OF THE INVENTION

The invention relates to a concrete shielding housing for receiving and storing a fuel element container filled with spent nuclear reactor fuel elements. The container is suitable for transport and storage. The outer dimensions of the container are somewhat smaller than the clear interior dimensions of the concrete shielding housing.

The concrete shielding housing has a pallet-like base, a concrete shielding wall placeable on the base, and a cover which can be placed atop the upper end of the concrete shielding wall. At the lower region of the concrete shielding housing, at least one air inlet opening is provided and, in the upper region of the concrete shielding housing, at least one air outlet opening is provided.

BACKGROUND OF THE INVENTION

In efforts to provide a temporary storage for fuel element containers in the open, it has been suggested to accommodate the containers in silo-like housings made of concrete or steel-reinforced concrete. The silo-like housings can be of different configurations and each is suitable for accommodating one fuel element container. In one configuration of a shielding housing for receiving fuel element containers, the shielding housing is provided with lateral air inlet passages at the lower end of the concrete shielding wall and lateral air outlet passages in the region of the upper end of the shielding wall beneath the cover. With this arrangement of the air inlet and air outlet openings, a natural ventilation within the housing is obtained for directing away heat produced by the radioactive decay of materials stored in the container.

The base of the concrete shielding housing is configured as a separate pallet which can be moved about from one location to another with the aid, for example, of a fork-lift truck. The fuel element container and the concrete shielding wall of the concrete shielding housing can be set down upon this base.

The pallet-like base makes it possible to move the entire concrete shielding housing and container to a location on the storage field after the fuel element container is delivered and the concrete shielding housing is put together. Again, a suitable vehicle for moving this entity from one location to another could be, for example, a fork-lift truck. The storage field is preferably in the open air and is therefore subjected to the weather elements.

SUMMARY OF THE INVENTION

It is an object of the invention to provide a concrete shielding housing of the type referred to above wherein the surface water which collects on the surface of the concrete shielding housing during a rainfall can be run off. The concrete shielding housing according to the invention includes a pallet-like base and a concrete shielding wall placeable upon the base. A removable cover is placeable atop the shielding wall. The outer dimensions of the container are somewhat smaller than the clear interior dimensions of the housing. According to a feature of the invention, the base has a plan profile smaller than the plan profile of the concrete shielding wall whereby the shielding wall overlaps the base when placed thereon.

By constructing the pallet-like base pursuant to the invention as described above, the water collecting on the outer surface of the concrete shielding housing can run off and drip from the overlapping concrete shielding wall to the ground. This advantageous runoff of water minimizes the disadvantageous effects of the weather elements. A further significant advantage of the invention is that this configuration enables the transporting corridor in the container field to be dimensioned narrower.

In another advantageous embodiment of the invention, it is a feature to provide air inlet means formed at the lower end of the concrete shielding wall in the region of the latter overlapping the pallet-like base. The air inlet means are in the form of segment-like inner recesses arranged at the lower end of the concrete shielding wall. With this configuration, the conventional radial air inlet openings can be dispensed with. A further minimization of the radiation emanating from the shielding housing is an additional advantageous consequence of this arrangement. The simplification in the production of the air inlet openings is likewise a significant advantage.

The invention achieves advantageous runoff of the surface water from the concrete shielding housing and permits the transport corridors in the container storage field to be made narrower.

BRIEF DESCRIPTION OF THE DRAWINGS

The concrete shielding housing according to the invention is illustrated in the drawing wherein.

DESCRIPTION OF THE PREFERRED EMBODIMENTS OF THE INVENTION

Figure 1:
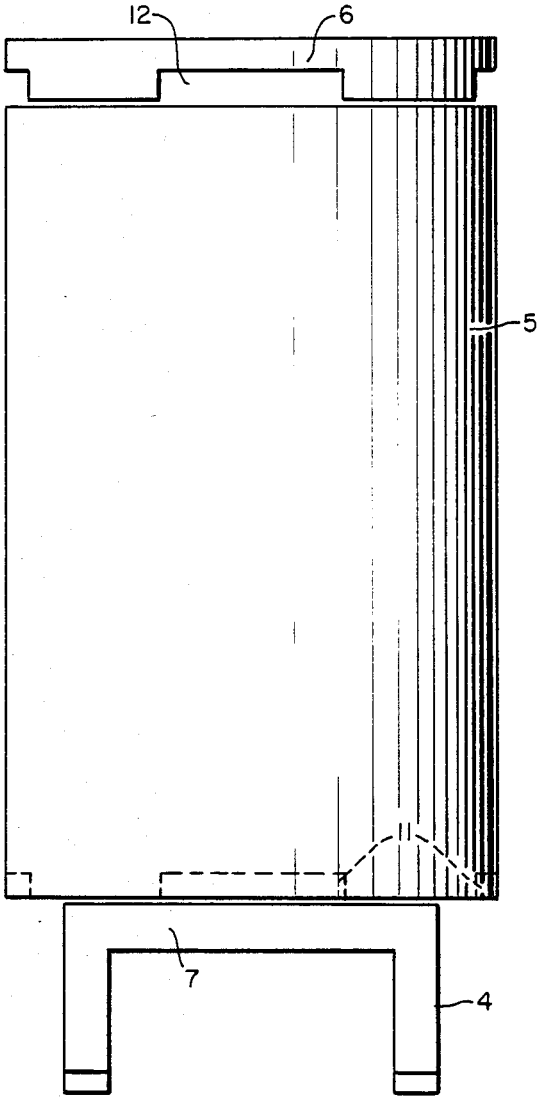
FIG. 1 is an elevation view of the concrete protective housing.
Figure 2:
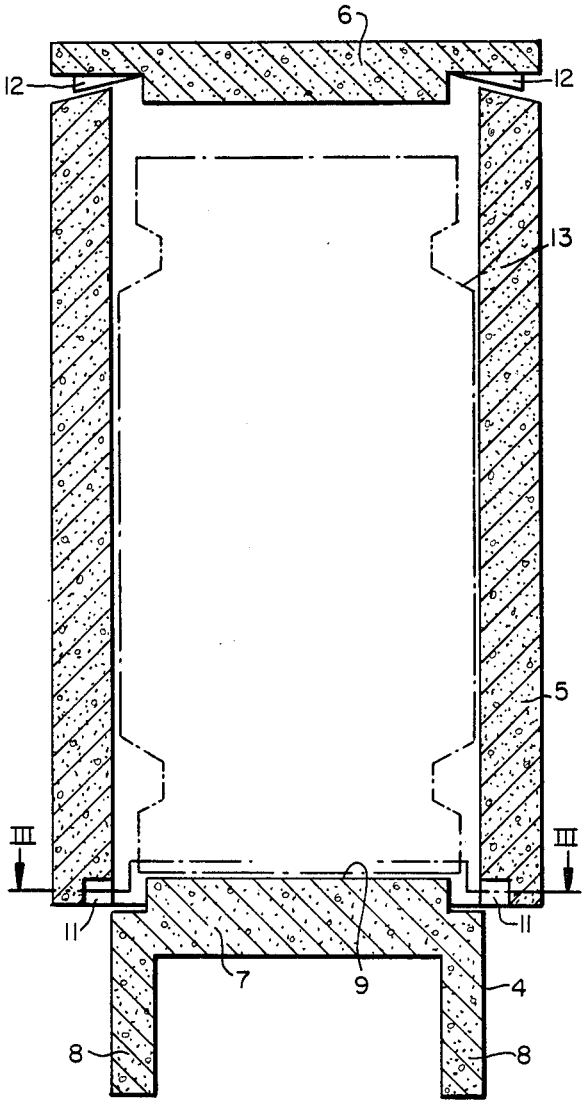
FIG. 2 is a section view of the housing of FIG. 1 taken along the line of II—II of FIG. 3.

Referring now to FIG. 1, the concrete shielding housing comprises a pallet-like base 4, a cylindrical concrete shielding wall 5 placed thereon, and a cylindrical cover 6 lying atop the concrete shielding wall 5.

The base 4 includes a square base plate 7 having feet 8 mounted at respective corners of the base plate 7 so that the base 4 is configured as a pallet accessible from beneath for moving the same from one location to another. The base plate 7 has a raised supporting or set-down surface 9 formed thereon. The raised surface 9 is of circular configuration and is centered upon the base. The diameter of the set-down surface 9 is smaller than the clear inner diameter of the cylindrical concrete shielding wall 5 which is placed upon the base 4 and aligned with respect thereto by means of alignment equipment (not shown).

The concrete shielding wall 5 has inner recesses 11 at its lower end. These recesses 11 are formed as segments and function as air inlet passages. The cover 6 lying upon the concrete shielding wall 5 is likewise provided with openings 12 at its periphery which serve as air outlet passages. The openings 12 are located at the surface of the cover engaging the wall 5.

The fuel element container 13 is shown in phantom outline and is depicted as standing on the set-down surface 9 of the base 4.

Figure 3:
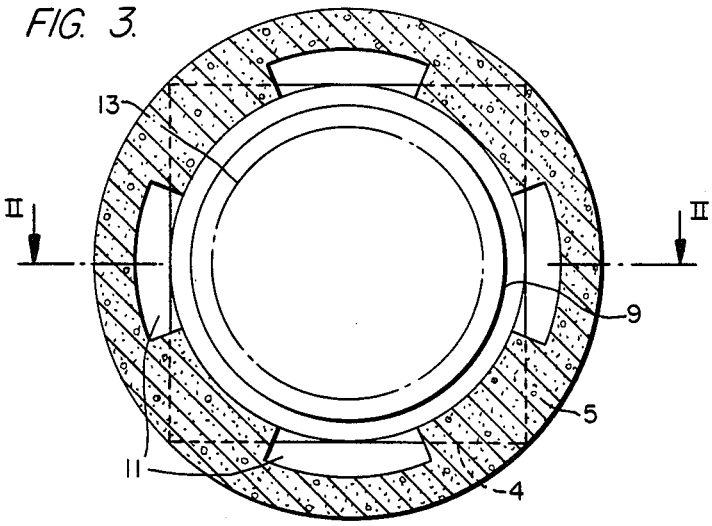
FIG. 3 is a section view of the concrete shielding housing taken along line III—III of FIG. 2.

In the illustrated embodiment, the outer diameter of the concrete shielding wall 5 corresponds to the length of the diagonal of the base plate of the pallet-like base 4. This is shown in FIG. 3 wherein the base 4 is depicted as having a profile when viewed in plan smaller than the profile of the concrete shielding wall 5 when viewed in plan so that the latter overlaps the base. The surface water running down the concrete shielding wall therefore drips directly onto the ground without it first coming to rest on projecting portions of the base 4.

Because the base 4 is smaller than the outer diameter of the concrete shielding wall 5, the transport corridors in the storage area can be dimensioned so that they are narrower than heretofore.

Other modifications and variations to the embodiments described will now be apparent to those skilled in the art. Accordingly, the aforesaid embodiments are not to be construed as limiting the breadth of the invention. The full scope and extent of the present contribution can only be appreciated in view of the appended claims.

What is claimed is:

1. A concrete shielding housing for receiving and storing a transportable fuel element container which is suitable for storage and filled with spent nuclear reactor fuel elements, the housing comprising:

a pallet-like base;

a concrete shielding wall placeable upon said base; and a removeable cover atop said shielding wall;

the clear interior dimensions of the housing being somewhat greater than the outer dimensions of the container;

air inlet means at the lower region of the housing for admitting air into the interior thereof;

air outlet means at the upper region of the housing for venting air from the interior thereof; and said base having a profile when viewed in plan smaller than the profile of said shielding wall when viewed in plan so as to cause the shielding wall to overlap the base when placed thereon whereby surface water running down the outer concrete shielding wall surface drips directly onto the ground without it first coming to rest on said base.

2. The concrete shielding housing of claim 1, said base having a square base plate upon which said concrete shielding wall rests, said wall being in the form of a cylinder, the diameter of said cylinder being equal to or greater than the diagonal dimension of said base plate.

3. The concrete shielding housing of claim 1, air inlet means formed in the lower end of said concrete shielding wall in the region thereof overlapping said base.

4. The concrete shielding housing of claim 3, said air inlet means comprising a plurality of inner recesses formed in said lower end of said concrete shielding wall.

* * * * *